US005295440A

United States Patent [19]

Cleveland

[11] Patent Number: 5,295,440

[45] Date of Patent: Mar. 22, 1994

[54] RAIL PULLER, WITH WEDGE CLAMP

[76] Inventor: Robert K. Cleveland, 2625 Angel Dr., Stockton, Calif. 95209

[21] Appl. No.: 54,692

[22] Filed: Apr. 29, 1993

[51] Int. Cl.[5] ..... E01B 29/04

[52] U.S. Cl. ..... 104/7.2; 104/2; 104/7.1; 104/307; 294/85; 294/103.1

[58] Field of Search ..... 104/2, 7.1, 7.2, 9, 104/307; 294/85, 103.1

[56] References Cited

U.S. PATENT DOCUMENTS

| | | | |
|---|---|---|---|
| 3,635,164 | 1/1972 | Patton | 104/2 X |
| 4,281,868 | 8/1981 | Lovitt | 104/307 X |
| 5,025,733 | 6/1991 | Pierobon | 104/9 |

FOREIGN PATENT DOCUMENTS

| | | | |
|---|---|---|---|
| 1133869 | 7/1962 | Fed. Rep. of Germany | 294/85 |

OTHER PUBLICATIONS

*Aldon Railway, Trucking & Material Handling Products*–1990 p. 31.

*Primary Examiner*—Robert J. Oberleitner
*Assistant Examiner*—S. Joseph Morano
*Attorney, Agent, or Firm*—Zarley, McKee, Thomte Voorhees & Sease

[57] ABSTRACT

A rail puller for attachment to the end of a rail comprising a top plate having side plates extending downwardly therefrom in a spaced-apart relationship. The bottom surface of the top plate is provided with a centrally disposed guide slot formed therein adapted to receive the tapered end of a wedge. An elongated rod is secured to the inside surface of each of the side plates near the lower end thereof. The puller is installed on a rail by slipping the same over the end of the rail. A wedge is then inserted into the guide slot of the top plate and is driven thereinto to force the elongated rods upwardly into frictional engagement with the underside of the head of the rail. A lifting bracket is provided on the top surface of the top plate and chain hooks are mounted on the exterior surfaces of the side plates to facilitate the connection of the puller to either a hoisting device, a Hy-Railer or the like.

12 Claims, 2 Drawing Sheets

RAIL PULLER, WITH WEDGE CLAMP

BACKGROUND OF THE INVENTION

1. Field of the Invention

This invention relates to a rail puller and more particularly to a rail puller which may be secured to the end of a rail to enable the rail to be moved from one location to another.

2. Background Art

In railroad track maintenance operations, it is frequently necessary to move a long length of rail from one location along the track to another location. Perhaps the first method by which the rails were moved was for several people to be positioned at each side of the rail with the rail then being lifted and carried to the desired location. However, such is not practical or feasible in modern times due to the amount of manpower required for such an operation. Further, the rail must sometimes be moved a considerable length along the track.

One prior art attempt at moving the rail was to wrap one end of a chain around one end of the rail with the other end of the chain being secured to a vehicle such as a Hy-Railer. The wrap-chain method was less than satisfactory due to the fact that one end of the track must be suspended above the ground while the chain is wrapped therearound. Further, the chain could slip during the pulling operation creating a serious safety hazard.

One type of rail puller has been previously sold by The Aldon Co., 3410 Sunset Avenue, Waukegan, Ill. 60087. However, the rail puller sold by The Alden Co. is extremely large and heavy and is not believed to be convenient to use. Further, the wedge which is driven into the Aldon AL-115 Rail Tugger to hold the puller on the rail is driven into the side of the device which is believed to seriously affect the gripping action of the puller on the rail.

SUMMARY OF THE INVENTION

An improved rail puller is disclosed which is adapted to fit various rail sizes. The rail puller of this invention comprises a horizontally disposed top plate having side plates extending downwardly from the opposite sides thereof. A rod is secured to the inside surface of each of the side plates adjacent the lower end thereof. The underside of the top plate is provided with a guide slot adapted to receive a wedge therein. A pair of chain hooks are secured to the outside surfaces of the side plates. An upstanding ear extends upwardly from the top surface of the top plate.

When it is desired to pull a rail, the puller is slipped over one end of the rail so that the head of the rail is positioned between the underside of the top plate and the rods secured to the inside surfaces of the side plates. A wedge is then inserted into the guide slot in the top plate and is driven thereinto to wedge the rods upwardly into engagement with the underside of the head of the rail. The end of the rail may be lifted by securing a winch cable or the like to the upstanding bracket. A chain may have its ends secured to the chain hooks with the chain then being connected to the hitch of a Hy-Railer or the like so that the rail may be pulled along the length of the track. The structure of the rail puller is such that it can accommodate rails of different sizes and is securely held in place by the wedge and positioned in the guide slot driven thereinto so that the rods on the inside surfaces of the side plates securely connect the puller to the rail.

It is therefore a principal object of the invention to provide an improved rail puller.

Still another object of the invention is to provide an improved rail puller which accommodates different sizes of rails.

Still another object of the invention is to provide a rail puller which is relatively light-weight so as to be easy to use.

Still another object of the invention is to provide a rail puller which includes a guide slot formed in the underside of the top plate thereof so that the wedge will be properly positioned.

Still another object of the invention is to provide a rail puller having chain hooks at the opposite sides thereof so that the rail puller may be connected to the hitch of a Hy-Railer or the like.

These and other object of the subject invention will be apparent to those skilled in the art.

DESCRIPTION OF THE PREFERRED EMBODIMENT

Figure 1:
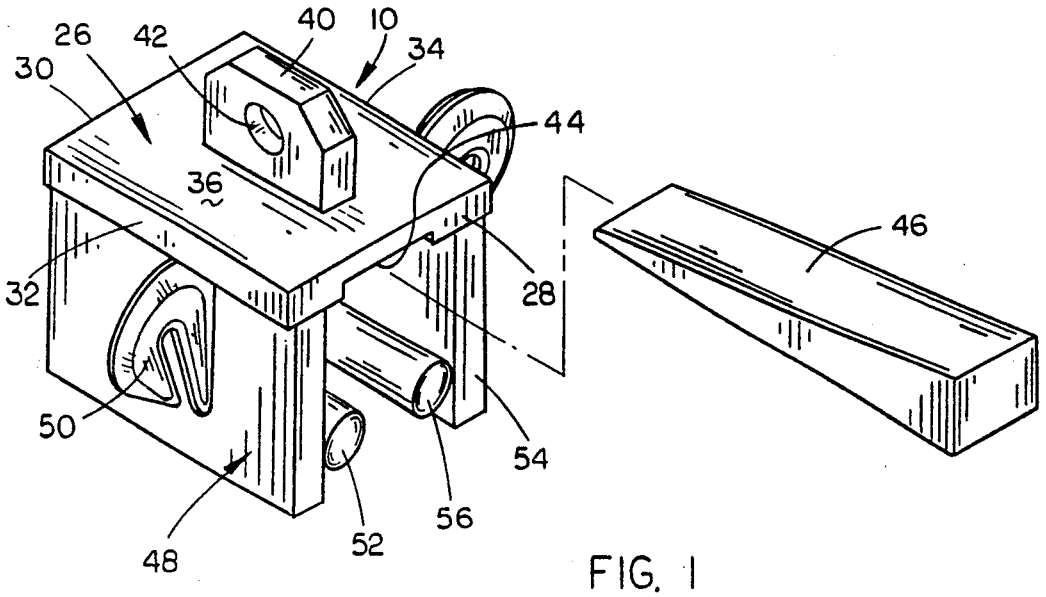
FIG. 1 is a perspective view of the rail puller of this invention.

The rail puller of this invention is referred to generally by the reference numeral 10 and is adapted to be mounted on one end of a rail 12. Rail puller 10 is adapted to be secured to different sizes of rails as will be described in more detail hereinafter. For purposes of description, rail 12 will be described as comprising a base 14, web 16, and head or ball 18. Further for purposes of description, head 18 will be described as having a top surface 20 and opposite bottom surfaces 22 and 24 which merge with the upper end of the web 16.

Puller 10 includes a top plate 26 having a forward end 28, rearward end 30, opposite sides 32 and 34, top surface 36 and bottom surface 38.

An upstanding ear or bracket 40 is secured to top surface 36 of plate 26 and extends upwardly therefrom. Bracket 40 is provided with an opening 42 formed therein to permit a chain, cable or hook to be connected thereto as will be described in more detail hereinafter. The bottom surface 38 of plate 26 is provided with a centrally disposed guide slot 44 formed therein adapted to receive one end of wedge 46.

Side plate 48 is secured to bottom surface 38 of plate 26 and extends downwardly therefrom adjacent side 32 as seen in FIG. 1. Chain hook 50 is secured to the outside surface of plate 48 as seen in the drawings. An elongated rod 52 is secured to the inside surface of plate 48 by welding or the like and extends between the forward and rearward ends thereof adjacent the lower end of plate 48. Similarly, side plate 54 is secured to the bottom surface 38 of plate 26 by welding or the like adjacent side 34 and extends downwardly therefrom. An elongated rod 56 is secured to the inside surface of plate 54 by welding or the like above the lower end thereof and extends between the ends thereof. Chain hook 57 is secured to the outside surface of side plate 54.

Figure 3:
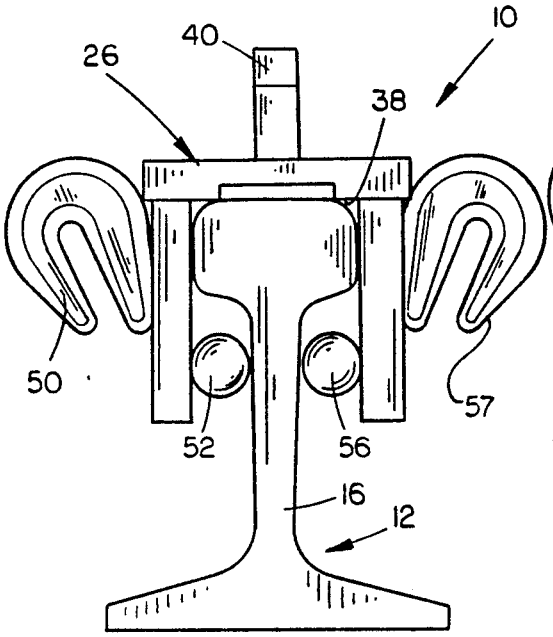
FIG. 3 is an end view of the rail puller mounted on the rail prior to the wedge having been inserted therein.
Figure 4:
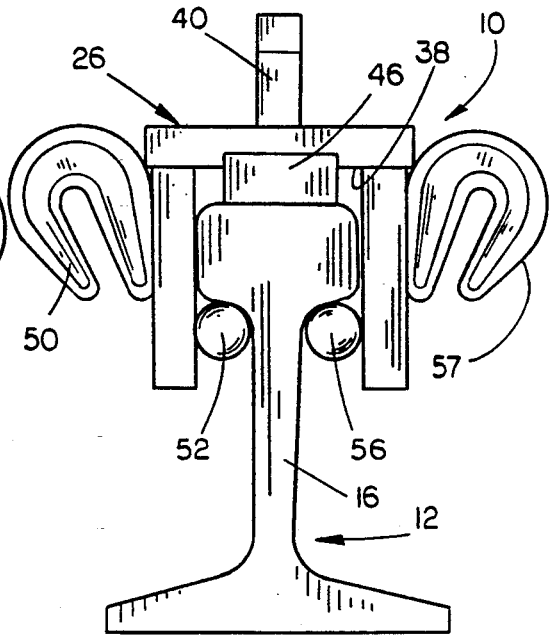
FIG. 4 is an end view similar to FIG. 3 but which shows the wedge having been installed.
Figure 5:
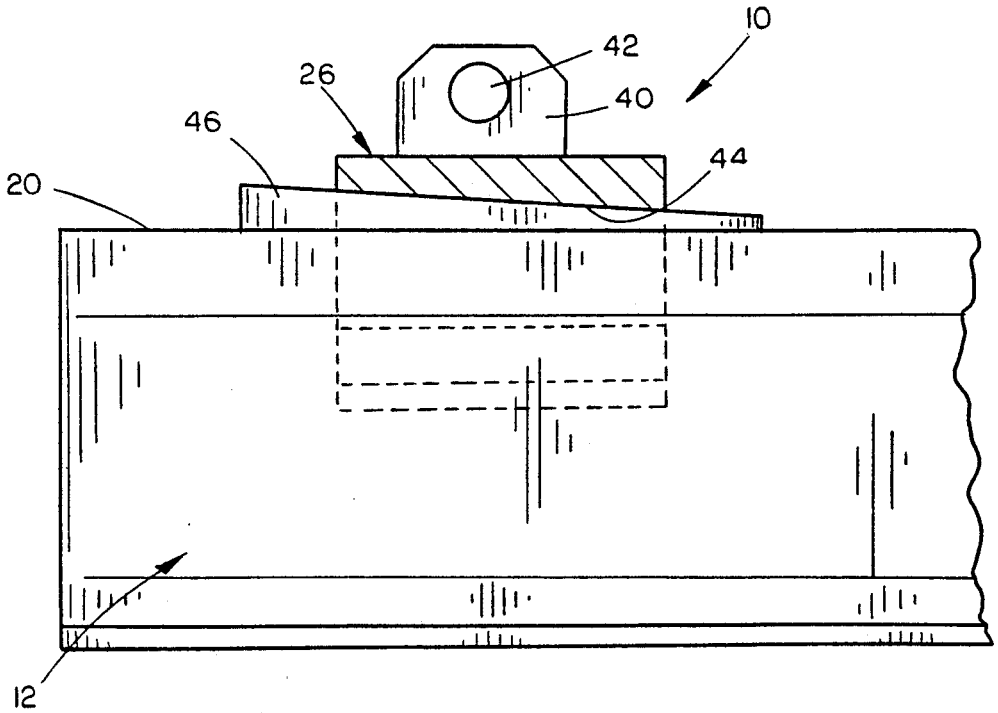
FIG. 5 is a vertical sectional view illustrating the rail puller mounted on a rail.

When it is desired to pull the rail 12 from one location to another, the rail puller 10 is slipped over the end of the rail as illustrated in FIG. 3. As seen in FIG. 3, since the distance between the upper ends of the rods 52 and 56 and the bottom surface 38 of plate 26 is greater than the vertical thickness of head 18, the puller 10 may be inserted onto the ends of rails having various sizes. When the rail puller 10 has been slipped over the end of the rail 12, the tapered end of wedge 46 is inserted into the guide slot 44 and is driven thereinto by a hammer or the like. The guide slot 44 ensures that the wedge 46 will be centrally positioned over the head 18 of rail 12. The forcing of the wedge 46 between the top surface 20 of the head 18 of rail 12 and the bottom surface 38 of plate 26 causes the puller to be raised relative to the rail so that rods 52 and 56 are moved upwardly into frictional engagement with the surfaces 22 and 24 of head 18. Thus, with the wedge 46 driven into the slot 44, rail puller 10 is securely mounted on the rail 12.

Figure 2:
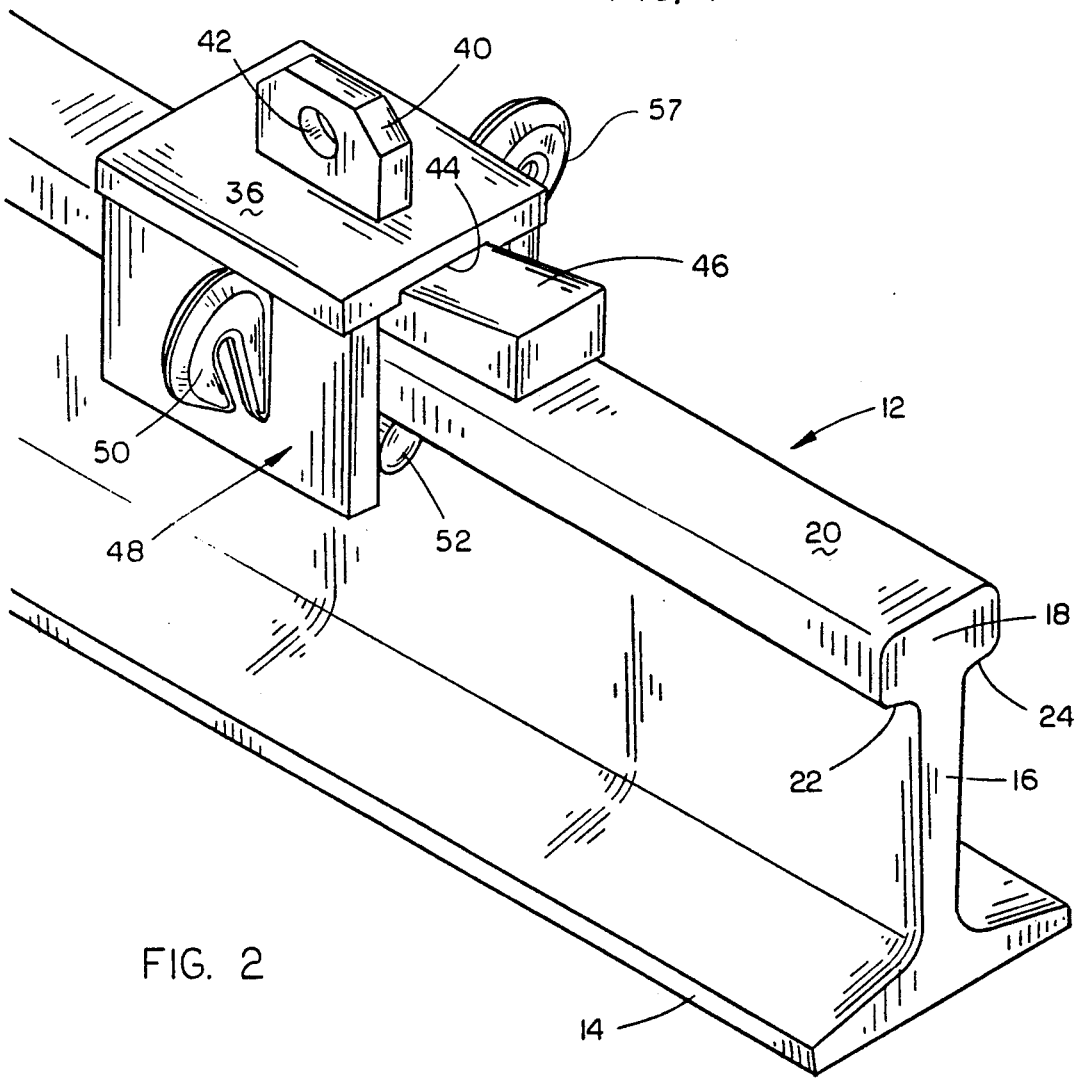
FIG. 2 is a perspective view of the rail puller mounted on a rail.

The end of the rail 12 may be raised, if desired, by connecting a winch cable or the like to the bracket 40. If it is desired to pull the rail along the length of the track, one end of a chain may be secured to hook 50 with the other end of the chain being secured to hook 57. The chain may then be connected to the hitch of the Hy-Railer or the like so that the Hy-Railer may pull the rail from one location to another. When the rail has been pulled to the desired location, the puller 10 is removed from the rail by simply striking end 28 of plate 26 or bracket 40 with a hammer or the like to move the puller 10 to the left as viewed in FIG. 2 with respect to the wedge 46. Once the wedge 46 has been loosened, it may be removed from the puller. The puller 10 may then be slipped from the end of the rail.

Thus it can be seen that a novel rail puller has been provided which may be easily installed on rails of different sizes and which ensures that the rail puller will be positively maintained thereon. It can be seen that the rail puller of this invention accomplishes at least all of its stated objectives.

I claim:

1. A rail puller for attachment to the end of a rail having a base, a web extending upwardly therefrom, and a head at the upper end thereof, comprising, a generally flat top plate having opposite ends, opposite sides, a top surface and a bottom surface;

a first side plate secured to one side of said top plate and extending downwardly therefrom, and first side plate having opposite ends, and inner and outer surfaces;

a second side plate secured to the other side of said top place extending downwardly therefrom in a horizontally spaced relationship with respect to said first side plate, said second side plate having opposite ends and inner and outer surface, a first member secured to the inside surface of said first side plate and protruding inwardly therefrom;

a second member secured to the inside surface of said second side plate and protruding inwardly therefrom;

said first and second side plates being spaced so that the end of a rail may be positioned therebetween with the head of the rail being positioned below said top plate;

a wedge member having a width less than the distance between the upper ends of said first and second side plates so that said wedge member may be inserted and wedged between the upper surface of the said head of said rail and said top plate to force said first and second members into engagement with the underside of said head; and lift engaging means for engaging a lifting means for lifting the rail.

2. The rail puller of claim 1 wherein said first and second members each comprise an elongated, horizontally disposed member.

3. The rail puller of claim 2 wherein each of said elongated, horizontally disposed member comprises a rod.

4. The rail puller of claim 1 wherein said bottom surface of said top plate has a guide slot formed therein for receiving said wedge member.

5. The rail puller of claim 4 wherein said guide slot is centrally positioned between said side plates.

6. The rail puller of claim 3 wherein said rods are vertically spaced from the bottom surface of said top plate to permit the rail puller to be mounted on rails of different sizes.

7. The rail puller of claim 1 wherein said lift engaging means comprises an inverted chain hook mounted on the outer surface of each of said side plates.

8. The rail puller of claim 1 wherein said lift engaging means comprises a lifting eye mounted on the top surface of said top plate.

9. The rail puller of claim 8 wherein said lift engaging means comprises an inverted chain hook mounted on the outer surface of each of said side plates.

10. The rail puller of claim 9 wherein said bottom surface of said top plate has a centrally positioned guide slot formed therein for receiving said wedge member therein.

11. The rail puller of claim 10 wherein said first and second members each comprise an elongated, horizontally disposed rod member secured to the inside surface of its respective side plate adjacent the lower end thereof.

12. The rail puller of claim 11 wherein said rod members are sufficiently spaced from said bottom surface of said top plate so that the rail puller may be mounted on rails having various sizes.

* * * * *